US006202839B1

(12) United States Patent
Petersen et al.

(10) Patent No.: US 6,202,839 B1
(45) Date of Patent: Mar. 20, 2001

(54) TRI-FOLD BUSINESS CARD AND CD PORTFOLIO

(75) Inventors: Charles G. Petersen, Barrington; Sandra L. Waldowski, Chicago, both of IL (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/430,868

(22) Filed: Nov. 1, 1999

(51) Int. Cl.[7] ..... B65D 85/57

(52) U.S. Cl. ..... 206/308.1; 206/232; 206/311; 281/31; 281/38

(58) Field of Search ..... 306/308.1, 311, 306/232, 214, 215; 281/19, 31, 15.1, 29, 38, 45; 402/3, 14, 70, 73

(56) References Cited

U.S. PATENT DOCUMENTS

| | | | | |
|---|---|---|---|---|
| D. 135,393 | | 3/1943 | Weinger et al. . | |
| D. 250,342 | | 11/1978 | Testro et al. . | |
| D. 267,653 | | 1/1983 | Miller et al. . | |
| D. 302,830 | | 8/1989 | Popat et al. . | |
| D. 314,587 | | 2/1991 | Young . | |
| D. 322,628 | | 12/1991 | Young . | |
| D. 325,393 | * | 4/1992 | Schertz et al. | D19/26 |
| D. 341,373 | | 11/1993 | Stern . | |
| 665,256 | * | 1/1901 | McComb | 281/31 |
| 3,722,564 | * | 3/1973 | Croon | 206/311 |
| 4,314,635 | * | 2/1982 | Fraser et al. | 206/232 |
| 4,832,372 | | 5/1989 | Young . | |
| 5,199,743 | * | 4/1993 | Rosinski, III | 281/45 |
| 5,207,717 | * | 5/1993 | Manning | 206/232 |
| 5,215,398 | * | 6/1993 | White et al. | 281/31 |
| 5,445,251 | * | 8/1995 | Redwood | 206/524 |
| 5,782,349 | * | 7/1998 | Combs | 206/308.1 |
| 6,068,116 | * | 5/2000 | Bankhead | 206/232 |

* cited by examiner

*Primary Examiner*—Paul T. Sewell
*Assistant Examiner*—Shian Luong
(74) *Attorney, Agent, or Firm*—Emrich & Dithmar

(57) ABSTRACT

A portfolio including a sheet-like body having first and second spaced hinge lines dividing the sheet-like body into a first end section, a middle section, and a second end section each having respective front and rear surfaces. The first and second end sections are foldable between a closed position, wherein the second end section is disposed intermediate the first end section and the middle section, and an open position, wherein all three sections are in common alignment in a generally flat configuration. First compact disc-receiving pockets are disposed on the front surface of the second end section and open toward the first and second hinge lines when the portfolio is in the open position. Each first disc-receiving pocket completely encloses a respective compact disc inserted therein. Second disc-receiving pockets are disposed on the rear surface of the second end section and open away from the first hinge line when the first end section is folded towards the middle section. Each of the second disc-receiving pockets substantially enclose a respective compact disc inserted therein, with the first end section covering the exposed portion of the disc when the portfolio is in the folded configuration. Each of the disc-receiving pockets is preferably transparent and is in sealed connection with the second end section along three of its four edges. The portfolio further includes plural sheets with card-receiving pockets which are securely connected to the sheet-like body along the first hinge line.

18 Claims, 5 Drawing Sheets

TRI-FOLD BUSINESS CARD AND CD PORTFOLIO

TECHNICAL FIELD

This invention relates generally to portfolios and is particularly directed to portfolios including pockets for disc-shaped recording media.

BACKGROUND OF THE INVENTION

Business people generally find it convenient to carry portfolios containing tablets of writing paper. It is frequently desirable to provide additional features in a portfolio designed especially for businessmen, salesmen, or others who often travel. One popular feature, for example, includes pockets for storing business cards. This feature is particularly useful for salesmen to keep track of sales calls. An example of this type of portfolio can be found in U.S. Pat. No. 4,832,372. Examples of other features provided in portfolios such as holders for writing paper and calculators as well as indexed leaves can be found in U.S. Pat. Nos. Des. 135,393; 250,342; 267,653; 302,830; 314,587; 341,373; and 322,628.

None of these prior portfolios includes modern conveniences for the business person conducting a high-tech presentation or seminar touting his or her company and its products or services. Often such presentations utilize a computer to present video images and/or provide accompanying audio content stored on magnetic or optical recording media. The video images are often projected onto a large screen for viewing by an audience while the accompanying audio is carried over a loud speaker system. Alternatively, the video images may be displayed on one or more computer monitors, while the audio is provided by speakers connected to the computer.

SUMMARY OF THE INVENTION

The present invention is directed to a novel portfolio for carrying sales tools, and the like, in a conveniently sized package. First and second spaced hinge lines respectively divide the sheet-like body into a first end section, a middle section, and a second end section each having respective front and rear surfaces. The first and second end sections are foldable between a closed position, wherein the second end section is disposed intermediate the first end section and the middle section, and an open position wherein all three sections are in common alignment in a generally flat configuration.

At least one first disc-receiving pocket is disposed on the front surface of the second end section and preferably opens toward the first and second hinge lines when the portfolio is in the open position. When the portfolio is closed, the pocket opening faces the folded second hinge line to prevent a disc from becoming dislodged from the pocket. The first disc-receiving pocket completely encloses a first optical compact disc inserted therein and prevents the disc from being scratched or otherwise damaged when carried in the portfolio.

At least one second disc-receiving pocket is disposed on the rear surface of the second end section and opens toward the second hinge line. The second disc-receiving pocket substantially encloses a second optical compact disc inserted therein with the first end section covering the exposed portion of the disc when the portfolio is in the closed position. The second disc-receiving pocket opens away from the first hinge line when the first end section is folded towards the middle section. This allows a disc to be easily removed from the second disc-receiving pocket when the first end section is moved slightly away from the second end section.

In a preferred embodiment, the disc-receiving pockets are slightly larger than the diameter of the compact disc and hold the disc snugly in a close fitting relationship. The pockets are preferably transparent to allow the user to identify the compact disc without having to remove it.

An array of card-receiving pockets is attached adjacent the first hinge line. The card-receiving pockets are also preferably transparent and may be folded over either the first end section or the middle section, or over both sections when the portfolio is open.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 2:
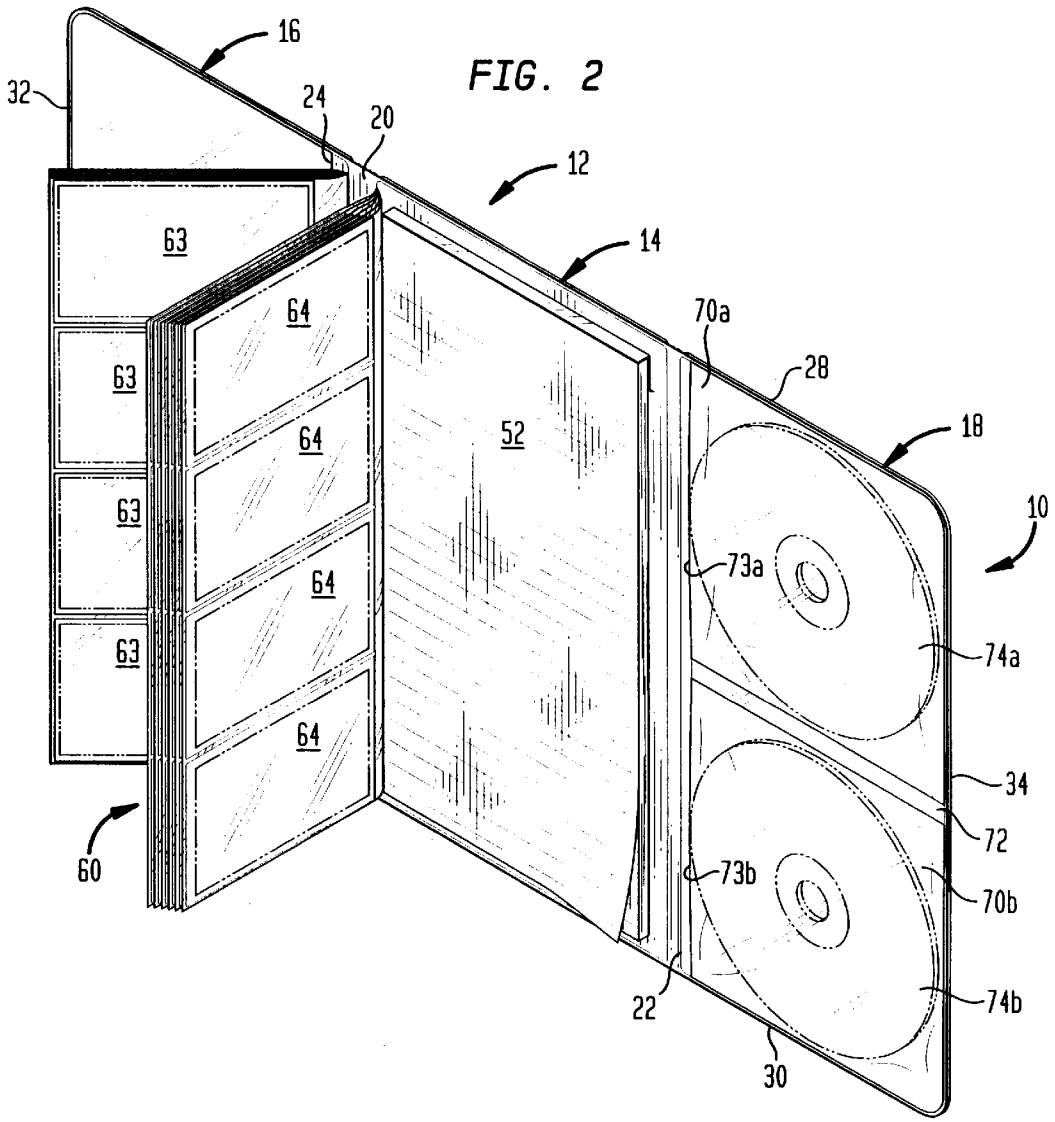
FIG. 2 is a perspective view of the inventive portfolio shown in an opened configuration.

Referring to the figures, there is shown a portfolio 10 according to principles of the present invention. The portfolio 10 is preferably in the form of a unitary sheet-like body 12 divided into three sections. Portfolio 10 includes a center or middle section 14 with first and second end sections 16 and 18. First and second hinge lines 20 and 22 respectively separate the first and second end sections 16 and 18 from the middle section 14. Body 12 has a front surface 24 and a rear surface 26, opposed top and bottom edges 28 and 30, and two opposed side edges 32 and 34.

Figure 1:
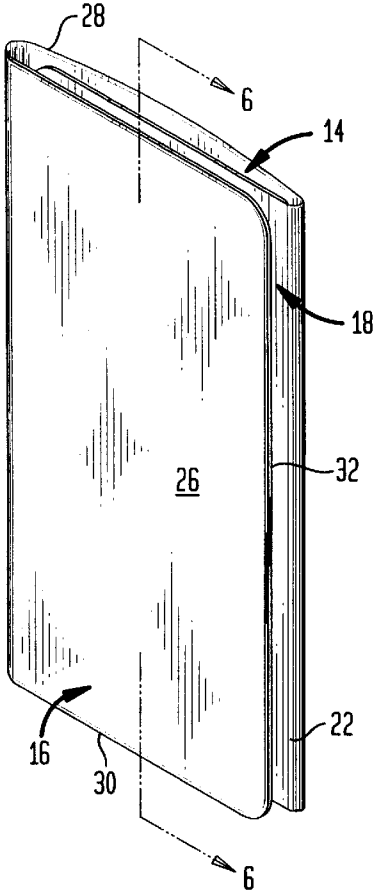
FIG. 1 is a perspective view of a portfolio in accordance with the present invention shown in the folded, or closed, configuration.

In a preferred form, hinge lines 20 and 22 divide the portfolio into the middle section 14 and the first and second end sections 16 and 18, with all three sections generally of equal size. To move the portfolio from the open position as shown in FIGS. 2, 3, 4, 5 and 7 to the closed position shown in FIGS. 1 and 6, the second end section 18 is folded over middle section 14 and then the first end section 16 is folded over both the middle section and the second end section. From the closed position, portfolio 10 can be moved to the open position by unfolding the two end sections 16 and 18 away from the middle section 14.

In one form, the front and rear surfaces 24 and 26 are comprised of thin sheets of leather or vinyl. Reinforcing members such as cardboard sheets (not shown) can be inserted in the three sections of the portfolio for additional strength. One of the cardboard sheets is placed within each of the first and second end sections 16,18 and the middle section 14 between the two thin outer sheets of leather or polymer, then the two outer sheets are adhered to one another along the top edge 28, the bottom edge 30, and the side edges 32 and 34. The two outer sheets are also adhered together between each cardboard sheet to form the first and second hinge lines 20 and 22.

Figure 5:
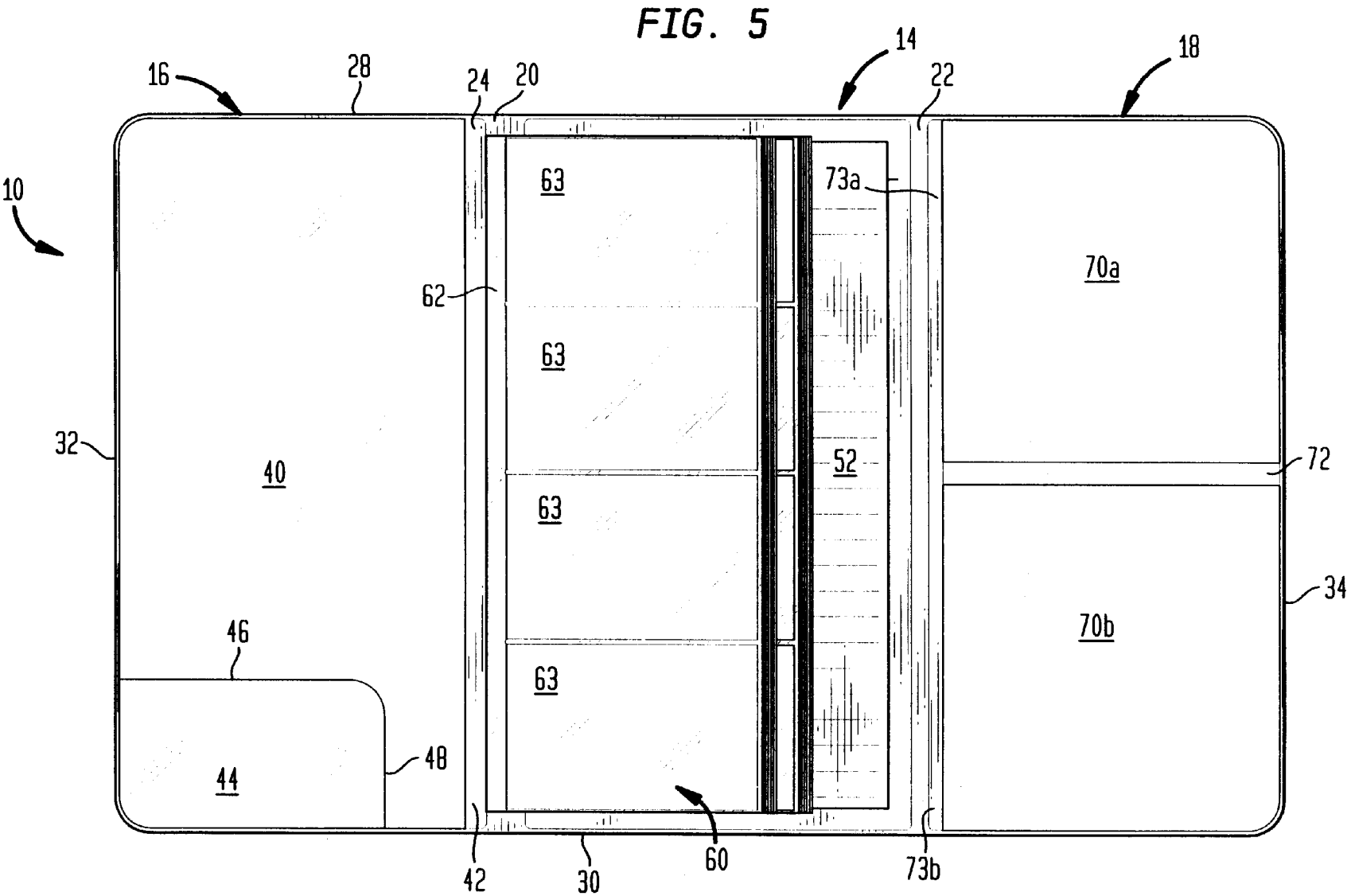
FIG. 5 is another view of the inventive portfolio showing the details of a card-receiving flap in the portfolio.
Figure 6:
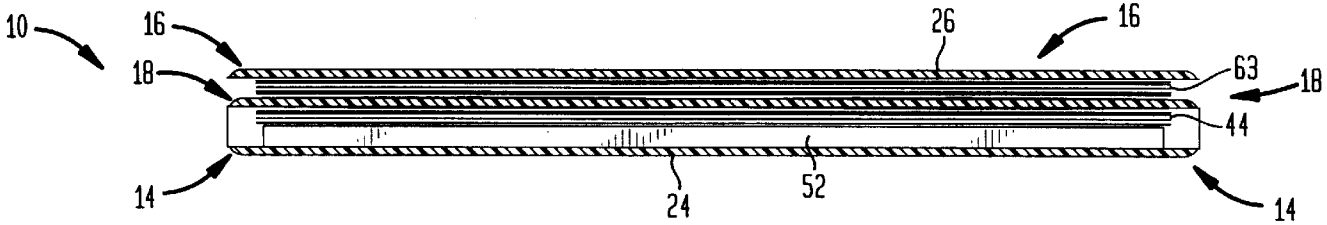
FIG. 6 is a cross-sectional view of the inventive portfolio in the folded configuration taken along sight line 6—6 in FIG. 1.

A document-receiving pocket 40 is shown in FIG. 5 as attached at three of its four marginal edges to the front surface 24 of the first end section 16. The three marginal edges of pocket 40 are attached to side edge 32, top edge 28, and bottom edge 30 of the first end section 16. Pocket 40 includes an open edge 42, defining an opening in the pocket which lies adjacent the first hinge line 20. Document-receiving pocket 40 is preferably transparent to permit viewing the contents of the pocket and is sized to receive a paper article such as a brochure or other sales literature.

Overlying pocket 40 is a card-receiving pocket, such as card-receiving flap 44 which is located in the corner defined by the bottom edge 30 and side edge 32 of the first end section 16. Card-receiving flap 44 is preferably joined at two of its four marginal edges to the bottom edge 30 and the side edge 32. Card-receiving flap 44 has two open edges 46 and 48 defining an opening which lies adjacent thereto. Card-receiving flap 44 is also preferably transparent and is sized to receive a business card.

In an alternative form, a card-receiving flap can be located in the corner defined by the bottom edge 30 and the first hinge line 20. In either case, card-receiving flap 44 and document-receiving pocket 40 are preferably joined to the first end section 16 in a single operation, such as by applying pressure and heat to bond adjacent edges of each sheet together.

The portion of front surface 24 overlying the middle section 14 includes an elongated, linear slot 50 formed therein so as to accommodate a bottom leaf (not shown) of a writing tablet 52. The writing tablet's bottom leaf is telescopically inserted through slot 50 into a pocket 51 formed between a portion of the front surface 24 and a cardboard sheet (not shown) or the rear surface 26. If desired, the front surface 24 of the middle section 14 can be made of a stronger material than that from which the rest of the front surface is comprised. Similarly, appropriate reinforcement may be provided at the ends of slot 50 for more secure positioning of tablet 52 within the portfolio.

Figure 3:
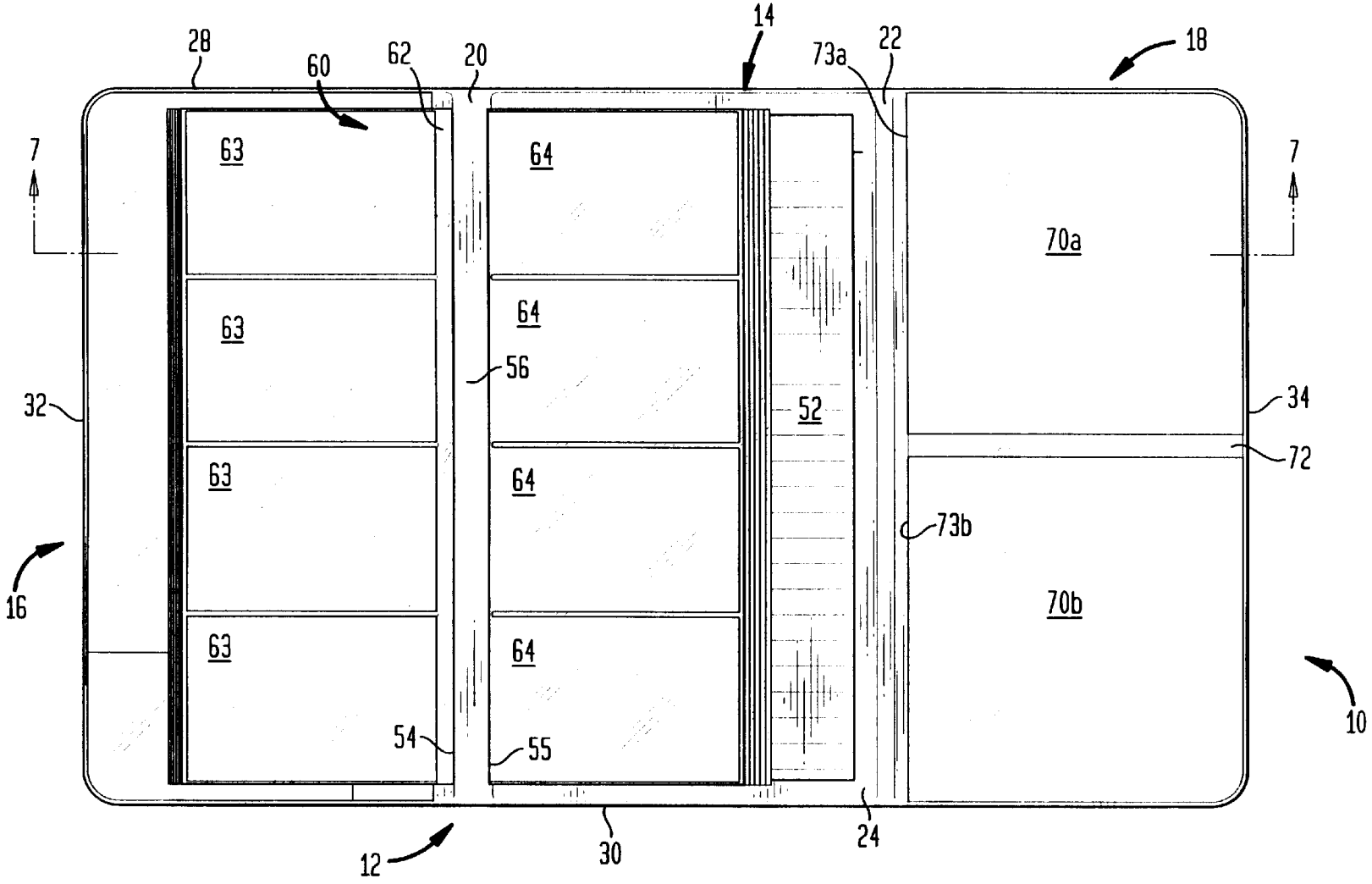
FIG. 3 is an elevational view of the portfolio of the present invention shown in the fully opened configuration with an array of card-receiving pockets disposed over the portfolio's adjacent first and second sections.

Two spaced vertical slits 54 and 55 are provided in the front surface 24 adjacent the first hinge line 20 and form a strip 56 in the front surface as shown in FIG. 3. One, and preferably multiple, sheets 60 having a gap 62 separating two laterally spaced-apart columns of card-receiving pockets 63 and 64 are provided. Sheet 60 is inserted through slits 54 and 55 so that the gap 62 is lined up underneath strip 56 so that first card-receiving pockets 63 are located on one side of the strip, while the second card-receiving pockets 64 are located on the other side of the strip.

In a preferred form, sheet 60 comprises a transparent polymer sheet with card-receiving pockets 63 and 64 sized to receive a business card, an international business card, or similarly sized cards. Gap 62 of sheet 60 is preferably non-removably attached to strip 56 such as by the application of heat and pressure. Sheet 60 is therefore securely attached to hinge line 20.

Figure 4:
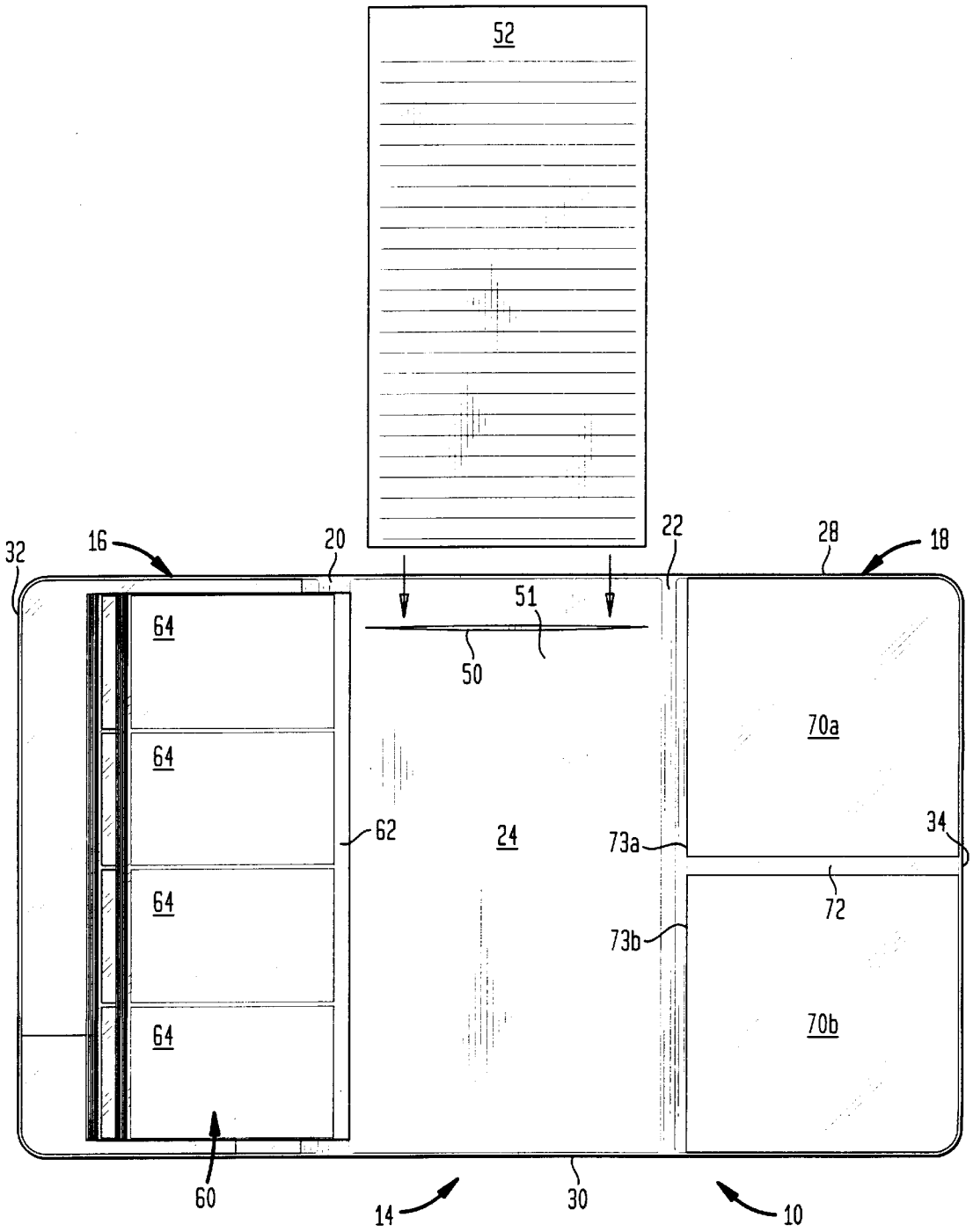
FIG. 4 shows the portfolio of the present invention in the opened, or unfolded, configuration and illustrates the insertion of a writing tablet in the portfolio.

Even when multiple sheets 60 are used, the indicia on each business card or other information card is easily viewed by folding over each sheet, so as to expose an adjacent transparent card-receiving pocket and the business card or other material therein. In use, sheets 60 can be alternately folded over the middle section 14 as shown in FIG. 5 or over the first end section 16 as shown in FIG. 4. Alternatively, the card-receiving pockets can be positioned over the first end section 16 and the middle section 14 as shown in FIG. 3.

Two first disc-receiving pockets 70*a* and 70*b* are attached at three of their four marginal edges to the front surface 24 of the second end section 18. The three marginal edges of pockets 70*a* and 70*b* are attached to side edge 34, to the top and bottom edges 28, 30 and to a strip-like intermediate portion 72 of the second end section 18. Pockets 70*a*, 70*b* have respective open edges 73*a* and 73*b* defining an opening which lies adjacent second hinge line 22. The first disc-receiving pockets 70*a*, 70*b* are preferably transparent and are sized to receive in tight fitting relation a recording medium, such as optical compact discs, or CDs, 74*a* and 74*b*, as shown in dotted line form in FIG. 2.

The first disc-receiving pockets 70*a*, 70*b* on front surface 24 are preferably large enough to completely cover a compact disc 74 and protect it from scratches, such as from writing table 52 or card-receiving pockets 63 and 64. However, the disc-receiving pockets 70*a*, 70*b* should also be small enough to engage a compact disc 74 in a tight-fitting manner in order to prevent the compact disc from falling out. One suitable size for the disc-receiving pocket measures approximately 4¾ to 5" respectively in the horizontal and vertical directions as viewed in the figures.

The open edges 73*a*, 73*b* of first disc-receiving pockets 70*a*, 70*b* on front surface 24 preferably face hinge lines 20 and 22 when the portfolio is in the open position as shown in FIGS. 3, 4 and 5. However, when the second end section 18 is folded over middle section 14, such as when portfolio 10 is in the closed position, the open edges 73*a*, 73*b* face away from the first hinge line 20 and towards the second hinge line 22. If a compact disc is displaced within its associated storage pocket, the folded-over second hinge line 22 will prevent the compact disc from falling out of the pocket.

Figure 7:
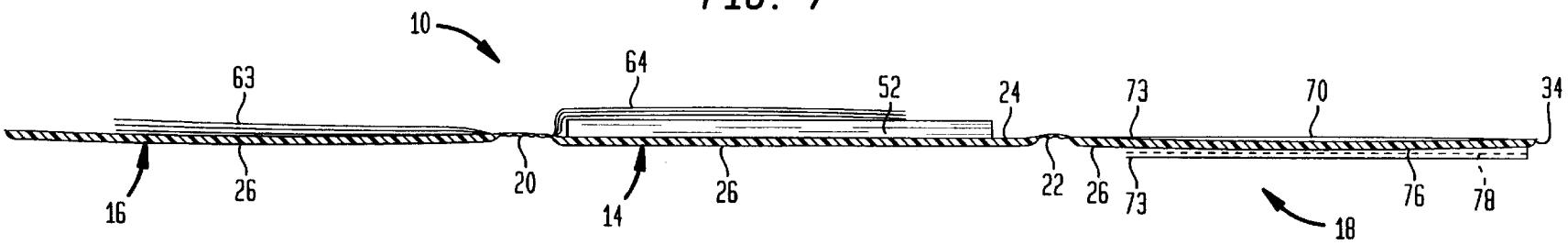
FIG. 7 is a cross-sectional view of the inventive portfolio in the unfolded, or open, configuration taken along sight line 7—7 in FIG. 3.

As shown in FIG. 7, a nearly identical second disc-receiving pocket 76 is attached at three of its four marginal edges to the rear surface 26 of the second end section 18. However, the second disc-receiving pocket 76 on rear surface 26 is preferably slightly shorter in the horizontal direction than the first disc-receiving pockets 70*a*,70*b*. The disc-receiving pocket 76 is preferably short enough so that it does not completely cover a compact disc 78 (shown in dotted line form) inserted therein. The resulting exposed portion of the compact disc 78 allows it to be easily retrieved. One example of such a disc-receiving pocket measures approximately 4¼ to 5" in the horizontal direction and approximately 4½" in the vertical direction. In a preferred embodiment, a pair of second disc-receiving pockets are disposed on the rear surface 26 of the second end section 18, although only one pocket is shown in the figures for simplicity.

The second disc-receiving pocket 76 on the rear surface 26 can be shorter than the first disc-receiving pockets 70*a*,

70*b* on the front surface 24 of the second section because, when the portfolio 10 is closed, the exposed portion of compact disc 78 contacts only the smooth surfaces of the first end section 16 and document-receiving pocket 40. Therefore, the exposed portion of disc 78 will not be scratched if the first end section 16 is sized to completely cover the exposed portion of the disc when the portfolio 10 is in the closed position.

As in the case of the previously described first disc-receiving pockets 70*a*, 70*b*, the second pocket 76 has an open edge 73 defining an opening which lies adjacent the second hinge line 22. The open edge 73 faces hinge lines 20 and 22 when the portfolio is in the open position. However, when the second end section 18 is folded over middle section 14, such as when portfolio 10 is in the closed position, open edge 73 faces away from the first hinge line 20. In this configuration, the compact disc 76 is located on the rear surface 26 and is therefore not covered by the interior surface 24 of folded hinge 22. Rather, the compact disc 78 can be pulled from pocket 76 in a direction opposite the first hinge line 20, allowing disc 78 to be easily accessed when the portfolio 10 is opened even a small amount.

In a preferred embodiment, each of the disc-receiving pockets on surfaces 24 and 26 is made from a single sheet of transparent plastic. Preferably, two of the marginal edges of each of the disc-receiving pockets are joined to the second end section's side edge 34 and either the top or bottom edges 28 and 30 in a single operation, such as by applying heat and pressure to bond the appropriate edges of the plastic sheets together. The third marginal edges of both pockets are formed by sealing the single sheet to the second end section 18 along line 72.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A portfolio comprising:

a body;

first and second hinge lines dividing the body into first and second end sections and a middle section each having respective opposed front and rear surfaces, wherein said first hinge line is disposed between said first end section and said middle section and said second hinge line is disposed between said second end section and said middle section and wherein said first and second end sections are foldable from an open position toward said middle section to a closed position, wherein said second end section is disposed intermediate said first end section and said middle section when in the closed position;

a first pocket disposed on the second end section of the portfolio;

a first disc-shaped recording medium disposed in said first pocket;

first and second spaced slots disposed in the front surface of the body defining a strip therein, wherein said slots are positioned adjacent to and on opposite sides of said first hinge line;

a sheet having first and second arrays of card-receiving pockets and a spacer disposed intermediate said first and second arrays, wherein said spacer is disposed under said strip with said first and second arrays of card-receiving pockets disposed on opposed sides of said strip; and a sealed connection between said spacer and said strip for maintaining said sheet permanently attached to said body in a fixed manner.

2. The portfolio of claim 1 wherein the front and rear surfaces of said second end section are respectively disposed in closely spaced, facing relation to the front surface of said middle section and to the front surface of said first end section when the portfolio is in the closed position, and wherein said first pocket is disposed on the front surface of said second end section and completely encloses the first disc-shaped recording medium disposed therein.

3. The portfolio of claim 2 wherein said first pocket includes an open edge portion disposed adjacent and in facing relation to said second hinge line.

4. The portfolio of claim 3 further comprising a second pocket disposed on the rear surface of said second end section and a second disc-shaped recording medium disposed in said second pocket in a tight-fitting manner.

5. The portfolio of claim 4 wherein said second pocket substantially covers said second recording medium leaving a portion of said second recording medium not covered by said second pocket when said second recording medium is fully inserted therein.

6. The portfolio of claim 5 wherein said first end section completely covers said second recording medium including the portion of said second recording medium not covered by said second pocket when the portfolio is in the closed position.

7. The portfolio of claim 6 wherein said second pocket includes an open edge portion disposed adjacent said second hinge line and facing away from said first hinge line when the portfolio is in the closed position.

8. The portfolio of claim 7 wherein the first and second pockets are transparent.

9. The portfolio of claim 8 wherein said first and second disc-shaped recording media are compact discs.

10. A portfolio comprising:

a body;

first and second hinge lines dividing said body into first and second end sections and a middle section each having respective opposed front and rear surfaces, wherein said first hinge line is disposed between said first end section and said middle section and said second hinge line is disposed between said second end section and said middle section and wherein said first and second end sections are foldable from an open position toward said middle section to a closed position with said second end section disposed intermediate said first end section and said middle section when in the closed position;

first and second spaced slots disposed in said front surface of said body defining a strip therein, wherein said slots are disposed adjacent to and on opposite sides of said first hinge line;

a sheet having first and second arrays of card-receiving pockets and a spacer disposed intermediate said first and second arrays, wherein said spacer is disposed under said strip with said first and second arrays of card-receiving pockets disposed on opposed sides of said strip;

a sealed connection between said spacer and said strip for maintaining said sheet securely connected to said body in a nonremovable manner;

means for recording indicia attached to the front surface of said middle section; and first and second pockets respectively disposed on said second end section front and rear surfaces of said second end section, wherein said first and second pockets are each adapted to receive in a tight fitting manner respective first and second disc-shaped recording media.

11. The portfolio of claim 10 wherein said second pocket substantially covers said second recording medium leaving a portion of said second recording medium not covered by said second pocket when said second recording medium is fully inserted therein.

12. The portfolio of claim 11 wherein said first end section completely covers said second recording medium including said portion of said second recording medium not covered by said second pocket when said portfolio is in said closed position.

13. The portfolio of claim 12 wherein said first disc-receiving pocket completely encloses said first disc-shaped recording medium.

14. The portfolio of claim 13 wherein said second disc-receiving pocket includes an open edge portion disposed adjacent said second hinge line and facing away from said first hinge line when said second end section is folded towards said middle section.

15. A portfolio comprising:

a body having opposed front and rear surfaces;

first and second hinge lines dividing the body into first and second end sections and a middle section each having respective opposed front and rear surfaces, wherein said first hinge line is disposed between said first end section and said middle section and said second hinge line is disposed between said second end section and said middle section, wherein said first and second end sections are foldable between a closed position wherein said second end section is disposed intermediate said first end section and said middle section and an open position wherein said sections are in common alignment in a generally flat configuration;

a pad-receiving pocket disposed on said middle section and opening towards said top edge;

first and second spaced slots disposed in the front surface of said body defining a strip therein, wherein said slots are positioned adjacent to and on opposite sides of said first hinge line;

a sheet having first and second arrays of card-receiving pockets and a spacer disposed intermediate said first and second arrays, wherein said spacer is disposed under said strip with said first and second arrays of card-receiving pockets disposed on opposed sides of said strip, wherein said spacer and said strip are securely connected together;

a document-receiving pocket disposed on the front surface of said first end section, said document-receiving pocket opening toward said first hinge line;

a card-receiving flap carried by the front surface of and coupled to said first end section;

a first disc-receiving pocket disposed on the second front surface of said second end section and opening toward said second hinge line, wherein said first disc-receiving pocket is adapted to receive in a tight fitting manner and completely enclose a first optical compact disc inserted therein; and a second disc-receiving pocket disposed on the rear surface of said second end section and opening away from said first hinge line when said second end section is folded towards said middle section, said second disc-receiving pocket adapted to receive in a tight fitting manner and substantially cover a second recording medium leaving a portion of said second recording medium not covered by said second pocket when said second recording medium is fully inserted therein.

16. A portfolio comprising:

a body having opposed front and rear surfaces;

first and second hinge lines dividing the body into first and second end sections and a middle section each having respective opposed front and rear surfaces, wherein said first hinge line is disposed between said first end section and said middle section and said second hinge line is disposed between said second end section and said middle section, wherein said first and second end sections are foldable from an open position toward said middle section to a closed position, and wherein said second end section is disposed intermediate said first end section and said middle section when in the closed position;

a first pocket disposed on the second end section of the portfolio and adapted to receive in a tight fitting manner a disc-shaped recording medium;

first and second spaced slots disposed in the front surface of the body defining a strip therein, wherein said slots are positioned adjacent to and on opposite sides of said first hinge line; and a sheet having first and second arrays of card-receiving pockets and a spacer disposed intermediate said first and second arrays, wherein said spacer is disposed under said strip with said first and second arrays of card-receiving pockets disposed on opposed sides of said strip, and wherein said spacer and said strip are securely connected in a nonremovable manner.

17. The portfolio of claim 16 wherein the front and rear surfaces of said second end section are respectively disposed in closely spaced, facing relation to the front surface of said middle section and to the front surface of said first end section when the portfolio is in the closed position, and wherein the first pocket is disposed on the front surface of said second end section and completely encloses the first disc-shaped recording medium disposed therein.

18. The portfolio of claim 17 wherein said first pocket includes an open edge portion disposed adjacent and in facing relation to said second hinge line.

* * * * *